US006662576B1

(12) United States Patent
Bai

(10) Patent No.: US 6,662,576 B1
(45) Date of Patent: Dec. 16, 2003

(54) REFRIGERATION SYSTEM WITH DE-SUPERHEATING BYPASS

(75) Inventor: Cheolho Bai, Taegu (KR)

(73) Assignee: VAI Holdings LLC, Phoenixville, PA (US)

( * ) Notice: Subject to any disclaimer, the term of this patent is extended or adjusted under 35 U.S.C. 154(b) by 9 days.

(21) Appl. No.: 10/253,000

(22) Filed: Sep. 23, 2002

(51) Int. Cl.[7] ..... F25B 5/00
(52) U.S. Cl. ..... 62/117; 62/197
(58) Field of Search ..... 62/197, 113, 513, 62/117, 216, 225, 5

(56) References Cited

U.S. PATENT DOCUMENTS

| | | | | | |
|---|---|---|---|---|---|
| 4,238,932 | A | * | 12/1980 | Schrader | 62/197 |
| 4,833,893 | A | * | 5/1989 | Morita | 62/713 |
| 5,095,712 | A | * | 3/1992 | Narreau | 62/113 |
| 6,250,086 | B1 | * | 6/2001 | Cho et al. | 62/5 |
| 6,293,108 | B1 | * | 9/2001 | Cho et al. | 62/5 |
| 6,389,818 | B2 | * | 5/2002 | Cho et al. | 62/5 |
| 6,425,249 | B1 | * | 7/2002 | Cho et al. | 62/5 |
| 6,430,937 | B2 | * | 8/2002 | Cho et al. | 62/5 |
| 6,449,964 | B1 | * | 9/2002 | Cho et al. | 62/114 |
| 6,467,303 | B2 | * | 10/2002 | Ross | 62/509 |
| 2003/0051489 | A1 | * | 3/2003 | Cho et al. | 62/114 |

* cited by examiner

*Primary Examiner*—Marc Norman

(74) *Attorney, Agent, or Firm*—Ostrolenk, Faber, Gerb & Soffen, LC

(57) ABSTRACT

A refrigeration system includes a compressor, a condenser, an expansion device and an evaporator connected in a closed circuit through which a refrigerant is circulated. A portion of liquid refrigerant exiting the condenser is diverted through a secondary expansion valve and a heat exchanger, which is thermally coupled between compressor and condenser, thereby allowing the superheated refrigerant vapor to be cooled at a temperature at or close to its saturation temperature when it enters the condenser. Hence, a de-superheating process inside the condenser is eliminated, and the condenser operates more efficiently, resulting in increased subcooling and thus increased cooling capacity. Also, the more efficient condenser decreases condenser pressure, a phenomenon which results in the reduction of the compressor work and accordingly increases the efficiency. The refrigerant vapor from the bypass line is maintained at an intermediate pressure between evaporator and condenser pressures and is combined with the low-pressure vapor from the evaporator through a pressure differential accommodating device, which may generate a vacuum by vortex flow of the superheated vapor from the bypass line, by flow of the superheated vapor through the throat of a venturi device, or in any other comparable manner. By increasing the amount of diverted refrigerant beyond that required for de-superheating, reduced cooling capacity can be achieved without the need for frequent on-off cycling of the compressor. The refrigeration system may employ a single refrigerant or a mixture of refrigerants such as R-134*a*, R-32 and R-125.

40 Claims, 10 Drawing Sheets

52
54
60
Pressurized fluid inlet 54
Liquid inlet
52
62
40
60
64
58

REFRIGERATION SYSTEM WITH DE-SUPERHEATING BYPASS

FIELD OF THE INVENTION

The present invention relates generally to a high efficiency refrigeration system and more specifically, to a refrigeration system utilizing a bypass path to perform refrigerant de-superheating outside the condenser thereby increasing the overall system efficiency.

BACKGROUND OF THE INVENTION

FIG. 1 is a block diagram of a conventional refrigeration system, generally denoted at 10. The system includes a compressor 12, a condenser 14, an expansion device 16 and an evaporator 18. These components are connected together via copper tubing such as indicated at 20 to form a closed loop system through which a refrigerant such as R-12, R-22, R-134a, R-407c, R-410a, ammonia, carbon dioxide or natural gas is cycled.

The main steps in the refrigeration cycle are compression of the refrigerant by compressor 12, heat extraction from the refrigerant to the environment by condenser 14, throttling of the refrigerant in the expansion device 16, and heat absorption by the refrigerant from the space being cooled in evaporator 18. This process, sometimes referred to as a vapor-compression refrigeration cycle, is used in air conditioning systems, which cool and dehumidify air in a living space, in a moving vehicle (e.g., automobile, airplane, train, etc.), in refrigerators and in heat pumps.

FIG. 2 shows the temperature-entropy curve for the vapor compression refrigeration cycle illustrated in FIG. 1. The refrigerant exits evaporator 18 as a saturated vapor (Point 1), and is compressed by compressor 12 to a very high pressure. The temperature of the refrigerant also increases during compression, and it leaves the compressor as superheated vapor (Point 2).

A typical condenser comprises a single conduit formed into a serpentine-like shape with a plurality of rows of conduit lying in a spaced parallel relationship. Metal fins or other structures which provide high heat conductivity are usually attached to the serpentine conduit to maximize the transfer of heat between the refrigerant passing through the condenser and the ambient air. As the superheated refrigerant gives up heat in the upstream portion of the condenser, the superheated vapor becomes a saturated vapor (Point 2a), and after losing further heat as it travels through the remainder of condenser 14, the refrigerant exits as saturated liquid (Point 3).

As the saturated liquid refrigerant passes through expansion device 16, its pressure is reduced, and it becomes a liquid-vapor mixture comprised of approximately 20% vapor and 80% liquid. Also, its temperature drops below the temperature of the ambient air (Point 4 in FIG. 2).

Evaporator 18 physically resembles the serpentine-shaped conduit of the condenser. Air to be cooled is exposed to the surface of the evaporator where heat is transferred to the refrigerant. As the refrigerant absorbs heat in evaporator 18, it becomes a saturated or slightly superheated vapor at the suction pressure of the compressor and reenters the compressor thereby completing the cycle (Point 1 in FIG. 2).

FIG. 3 shows the temperature-entropy curve for the vapor compression refrigeration cycle, in which the de-superheating process in the condenser is indicated explicitly. The pressure of the discharge vapor from the compressor has to be raised such that the phase-change temperature (known as the saturation temperature) at the saturation pressure can be large enough to reject heat at the condenser. This requires that the discharge vapor from the compressor is superheated as the entropy increases slightly over the compressor as shown in FIG. 2. Typically one-third of a condenser is utilized for the de-superheating process in most air-conditioning and refrigeration systems.

This is a source of significant inefficiency in conventional refrigeration systems as the condenser must be larger and more costly than needed for the heat transfer function involving the phase-change of the refrigerant. Conversely, for a condenser of a given size, if the first one-third does not need to be devoted to de-superheating, greater subcooling could be achieved.

An additional benefit which could be achieved by performing the de-superheating step outside the condenser would be an improved energy-efficiency ratio (EER). This is defined as Qv/Wc, where Qv is the heat absorption by the evaporator of the system and Wc is the work done by the compressor. By increasing subcooling for a given size condenser, a greater quantity of liquid in the refrigerant would enter the evaporator. This would increase the cooling capacity Qv, thus the EER would also increase. Furthermore, as the condenser becomes more efficient, the condenser pressure decreases, reducing the required pressure lift across the compressor, thereby reducing the compressor work and accordingly increasing the EER.

FIG. 4 illustrates a modified temperature-entropy curve showing what would happen if the de-superheating step could be performed between the compressor and the condenser. Heat would be removed from the vapor discharged from the compressor, reducing the temperature of the vapor substantially while the saturation pressure is almost unchanged. Consequently, the vapor from the compressor could enter the condenser at or close to its saturation temperature and pressure. This is illustrated in the modified temperature-entropy curve of FIG. 4 between points 2*c* and 2*a*. Up to now, however, no suitably cost effective technique has been available to eliminate the need for de-superheating in the condenser.

Therefore, a need clearly exists for a cost-effective way to achieve de-superheating at the inlet side of the condenser. The present invention seeks to meet this need.

SUMMARY OF THE INVENTION

According to the present invention, the de-superheating step is performed on the inlet side of the condenser, rather than in the condenser. To achieve this, a portion of liquid refrigerant exiting from the condenser is diverted into a bypass line from which it is re-injected into the primary refrigerant path at a location between the evaporator outlet and compressor inlet. In the bypass line, a secondary expansion valve is used to throttle the diverted liquid refrigerant from the condenser, thus decreasing the temperature substantially below the condenser outlet temperature.

The cooled refrigerant exiting the secondary expansion valve then passes through a heat exchanger which is thermally coupled to the primary refrigerant line between the compressor outlet and the condenser inlet. The heat exchanger removes heat from the refrigerant vapor exiting from the compressor, thus reducing its temperature. As a result, the refrigerant enters the condenser at or near its saturation temperature, and no portion of the condenser needs to be devoted to de-superheating.

Because the refrigerant pressure in the bypass line at the outlet of the heat exchanger is greater than the pressure at the evaporator outlet, a pressure differential compensating device is used to couple the outlet of the bypass line to the primary refrigerant line. The pressure differential compensating device can be either a vacuum generating device or a pressure-reducing device.

According to a first aspect of the invention, there is provided a refrigeration system including refrigerant compressing means, refrigerant condensing means, expansion means and evaporation means connected together to form a closed loop system with a refrigerant circulating therein, and a bypass line connected between the outlet of the condensing means and the inlet of the compressing means, the bypass line including a secondary expansion means, heat exchanging means to remove heat from the discharge vapor from the compressor between the outlet of the compressing means and an inlet of the condensing means, and a pressure differential accommodating means for mixing two vapors at two different pressures connecting the outlets of the evaporation means and the heat exchanging means to an inlet of the compressing means.

According to a second aspect of the invention, there is provided a refrigeration system comprised of a primary refrigerant path including a compressor, a condenser, a primary expansion device, and an evaporator connected together to form a closed loop system with a refrigerant circulating therein, and a bypass line connected between the outlet of the condenser and the inlet of the compressor, the bypass line including a heat exchanger thermally coupled to the primary refrigerant path between the compressor outlet and the condenser inlet to remove heat from the discharge vapor from the compressor, and a pressure differential accommodating device for mixing two vapors at two different pressures connecting the outlets of the evaporator and the heat exchanger to an inlet of the compressor.

Further according to the second aspect of the invention, the pressure differential accommodating means is a vacuum generating device with no moving parts such as a venturi tube, or a so-called "vortex tube" which is conventionally used to create two fluid steams of differing temperature from a single high pressure input stream. (Such a vortex generator is the subject of a copending U.S. provisional patent application entitled USE OF A VORTEX GENERATOR TO GENERATE VACUUM, Serial No. 60/356,059 filed in the names of Young Cho, Cheolho Bai, and Joong-Hyoung Lee on Feb. 11, 2002, the contents of which are hereby incorporated by reference.)

Further according to the second aspect of the invention, the pressure differential accommodating means is a pressure reducing device with no moving parts such as a capillary tube, an orifice, a valve, or a porous plug. The pressure reducing device is used in the bypass line which is maintained at a higher pressure than the evaporator. The pressure reducing device reduces the high pressure at the bypass line to the evaporator pressure so that two vapors can be mixed.

According to a third aspect of the invention, there is provided a method of increasing the efficiency of a refrigeration system comprised of a primary refrigerant path including a compressor, a condenser, a primary expansion device, and an evaporator connected together to form a closed loop system with a refrigerant circulating therein, the method comprising the steps of bypassing a portion of the refrigerant exiting the condenser into a secondary refrigerant line, passing the bypassed refrigerant through a heat exchanger thermally coupled to the primary refrigerant path between the compressor outlet and the condenser inlet to remove heat from the discharge vapor from the compressor, and passing the refrigerant exiting the heat exchanger and the refrigerant exiting the evaporator through a pressure differential accommodating device means that mixes two vapors at different pressures and feeding the refrigerant exiting the pressure differential accommodating device to an inlet of the compressor.

Providing a bypass path for performing de-superheating makes the condenser more efficient thereby reducing the condenser pressure, a phenomenon which decreases the pressure lift at compressor, and thus reduces the compressor work. Correspondingly, because de-superheating does not have to be done inside the condenser, the condenser becomes more efficient, and subcooling at the end of the condenser is increased. This increases the amount of liquid refrigerant after the throttling process through the main expansion valve. Thus, the heat absorption at the evaporator (often referred as the cooling capacity) increases.

The above-described benefits of the de-superheating bypass are achieved with diversion of 10–15% of the liquid refrigerant outflow from the condenser. At this level, reduced compressor work and increased cooling capacity are achieved. Since the EER (energy efficiency ratio) is defined as the ratio of the cooling capacity to compressor work, this increases the EER.

According to a fourth aspect of the invention, when more than 15%, for example, 30%, of the liquid refrigerant from the condenser is diverted to the bypass path, the cooling capacity is reduced due to the substantial decrease in the refrigerant mass flow rate circulating through the evaporator. By use of an adjustable valve in the bypass path, the bypass mass flow rate, and thus, the cooling capacity, can be varied according to the thermal load, whereby it is possible to operate an air conditioning or refrigeration system without frequent, highly energy-inefficient, ON-OFF operations of the compressor. This results in improved long-term seasonal energy efficiency ratio (SEER).

According to a fifth aspect of the invention, multiple evaporators can be employed, e.g., in a zoned cooling system. Thus, several small evaporators could be provided for separate rooms, with one condenser and one compressor. When all the rooms require cooling, the system can be operated with a 10% bypass rate to provide the maximum cooling capacity and the maximum efficiency. If the thermal load decreases, as when fewer rooms need to be cooled, the bypass rate can be increased to reduce the cooling capacity without the need to cycle the compressor on and off. This is quite beneficial because the repeated ON-OFF cycling of the compressor is a very energy-inefficient process.

The concepts of this invention are applicable to conventional single-refrigerant systems, and also to mixed-refrigerant systems using a combination of refrigerants selected to provide the desired combination of thermal and flammability characteristics. Such mixed-refrigerant systems may also include regenerative features which provide higher evaporator efficiency by increasing the percentage of liquid in the refrigerant as it enters the evaporator. Regenerative mixed refrigerant systems are disclosed, for example, in our U.S. Pat. No. 6,250,086 and 6,293,108, the contents of which are hereby incorporated by reference.

It is accordingly an object of this invention to provide an apparatus and method that eliminates the need for de-superheating to take place in the condenser of a refrigeration system.

It is also an object of the invention to increase the efficiency of known refrigeration systems by providing a cost-effective way of reducing the temperature and pressure of the discharge vapor from the compressor.

It is another object of the invention to increase the cooling capacity and EER of known refrigeration systems by providing a cost-effective way of reducing the temperature and pressure of the discharge vapor from the compressor.

A related object of the invention to allow use of smaller condensers in known refrigeration systems by providing a cost-effective way of reducing the temperature and pressure of the discharge vapor from the compressor.

An additional object of the invention is to provide a way of reducing the temperature and pressure of the discharge vapor from the compressor, which may be used in single-refrigerant systems and also in mixed-refrigerant systems, with and without regenerative features.

An additional object of the invention is to provide an improved refrigeration system in which the evaporator is connected to a substantially low pressure created by a vacuum-generating device thereby boosting the evaporator capacity.

An additional object of the invention is to provide an improved refrigeration system in which the mixing two different pressures using a vacuum generating device increases the suction pressure of the compressor, whereby the required pressure rise over the compressor is reduced, which, in turn, reduces the compressor work and increases the EER.

An additional object of the invention is to provide an improved refrigeration system in which the mixing two different pressure vapors are carried out using a vacuum generating device so that the pressure at the bypass line can be maintained at a higher pressure than the evaporator pressure.

An additional object of the invention is to provide an improved refrigeration system in which the mixing two different pressure vapors are carried out using a pressure-reducing device so that the pressure at the bypass line can be maintained at a higher pressure than the evaporator pressure.

Yet another object of the invention is to provide an improved refrigeration system in which de-superheating is performed outside the condenser in a bypass path to which refrigerant from the condenser outlet is diverted, into a bypass path, and in which the quantity of refrigerant diverted is controlled such that the cooling capacity can be adjusted to meet varying thermal requirements, whereby the system can be operated without the need for energy-inefficient repeated on and off cycling of the compressor.

BRIEF DESCRIPTION OF THE DRAWINGS

Throughout the drawings, like parts are given the same reference numerals.

DETAILED DESCRIPTION

Figure 1:
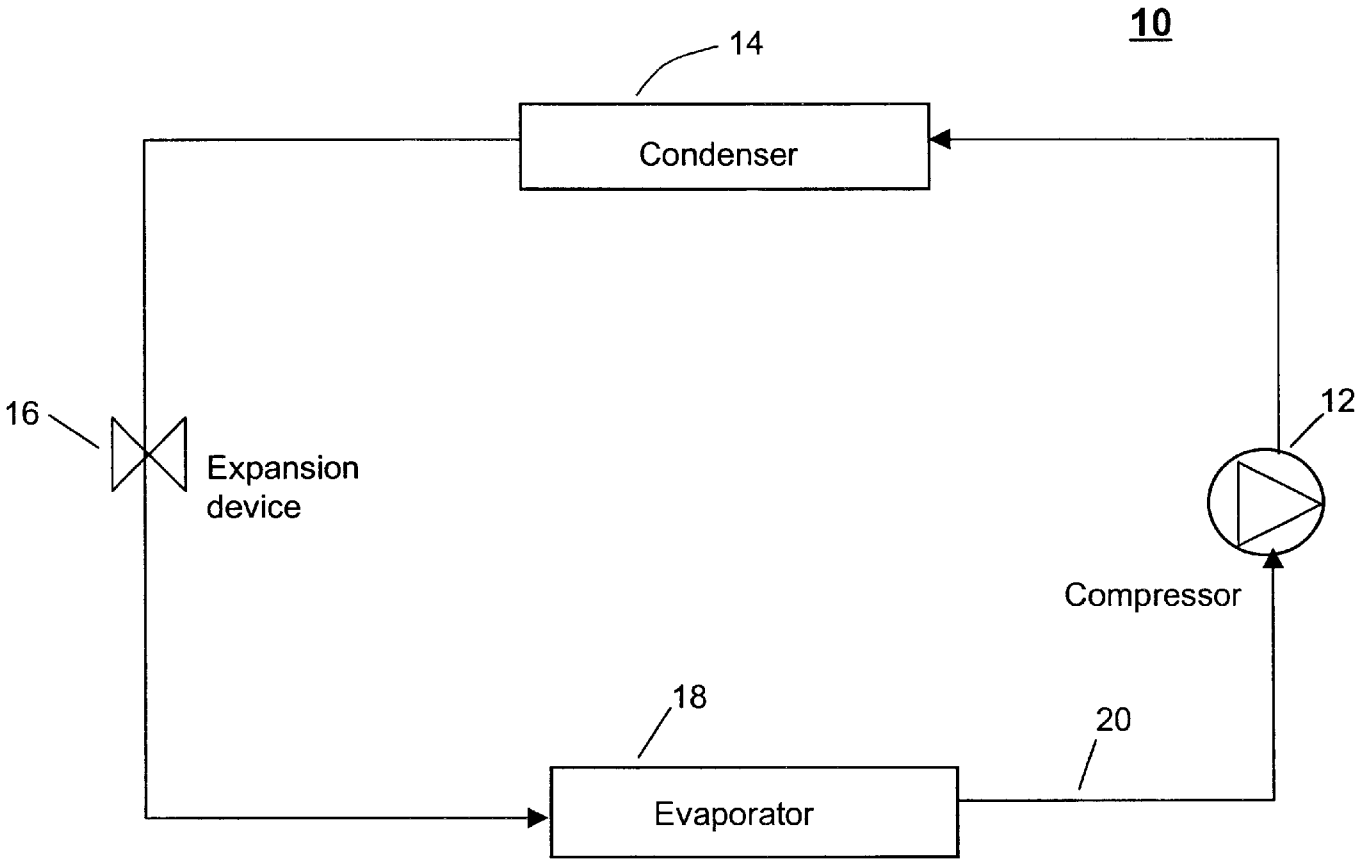
FIG. 1 PRIOR ART
FIG. 1 shows a block diagram of a conventional refrigeration system.
Figure 2:
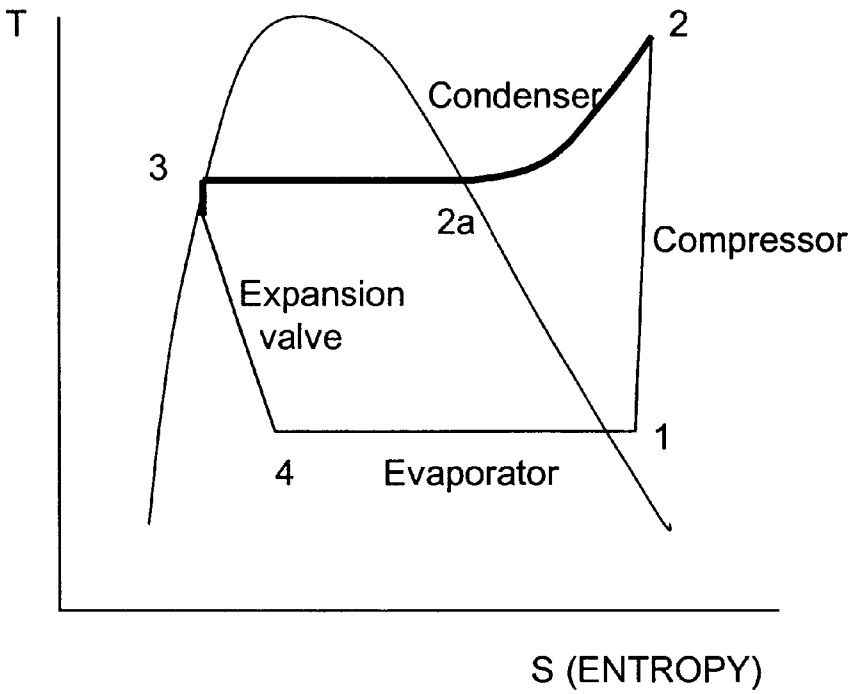
FIG. 2 shows a temperature-entropy curve for the conventional refrigeration system of FIG. 1.
Figure 3:
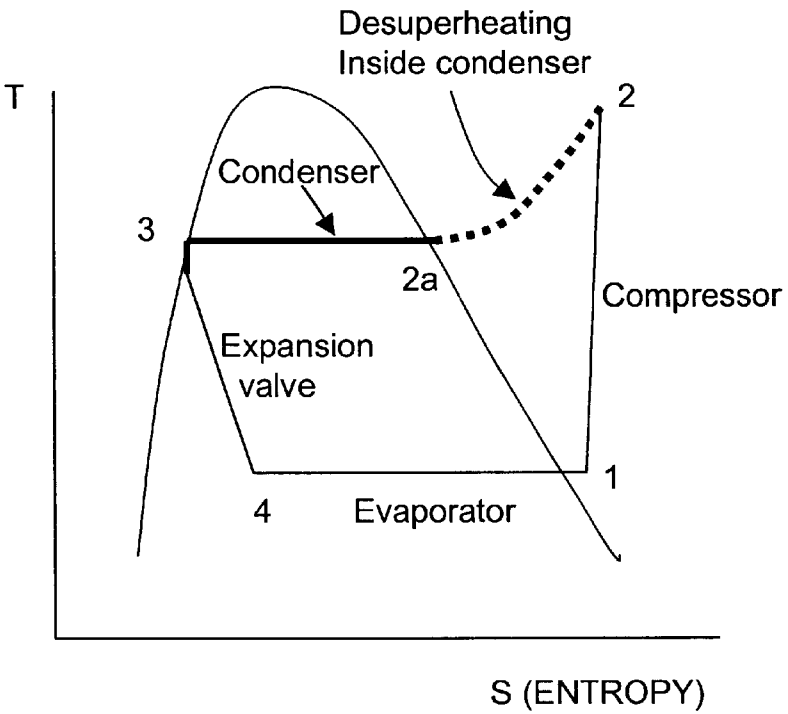
FIG. 3 shows a temperature-entropy curve for the refrigeration system of FIG. 1, where de-superheating process is indicated.
Figure 4:
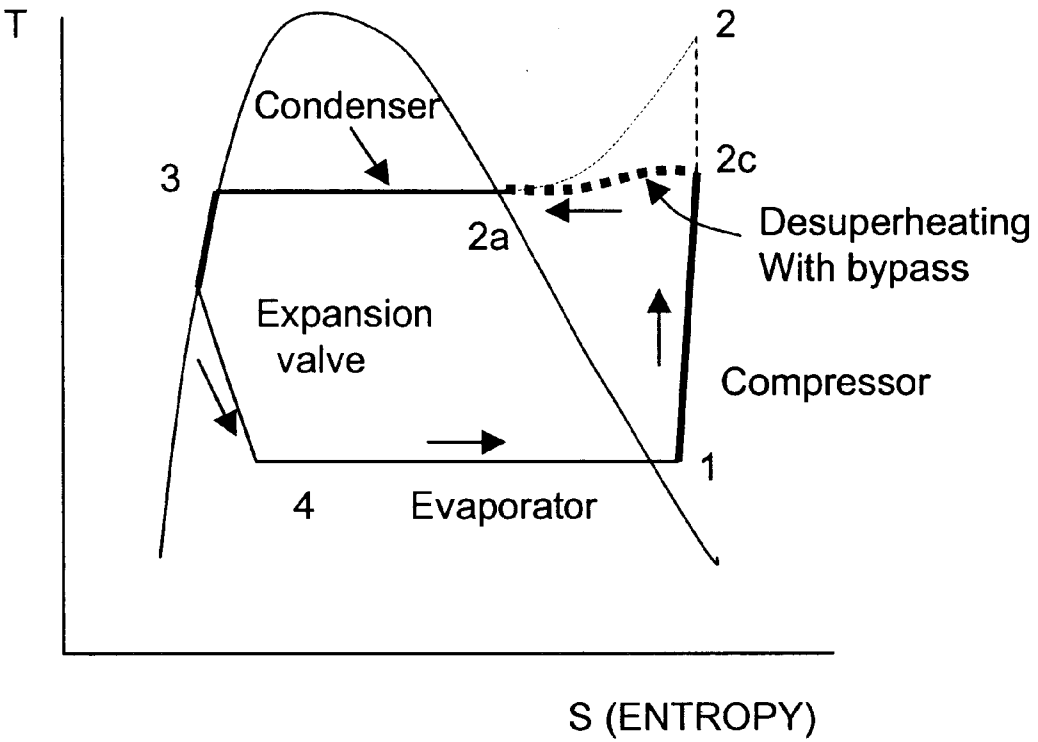
FIG. 4 shows a temperature-entropy curve for a refrigeration system in which de-superheating process is performed outside the condenser according to the present invention.
Figure 5:
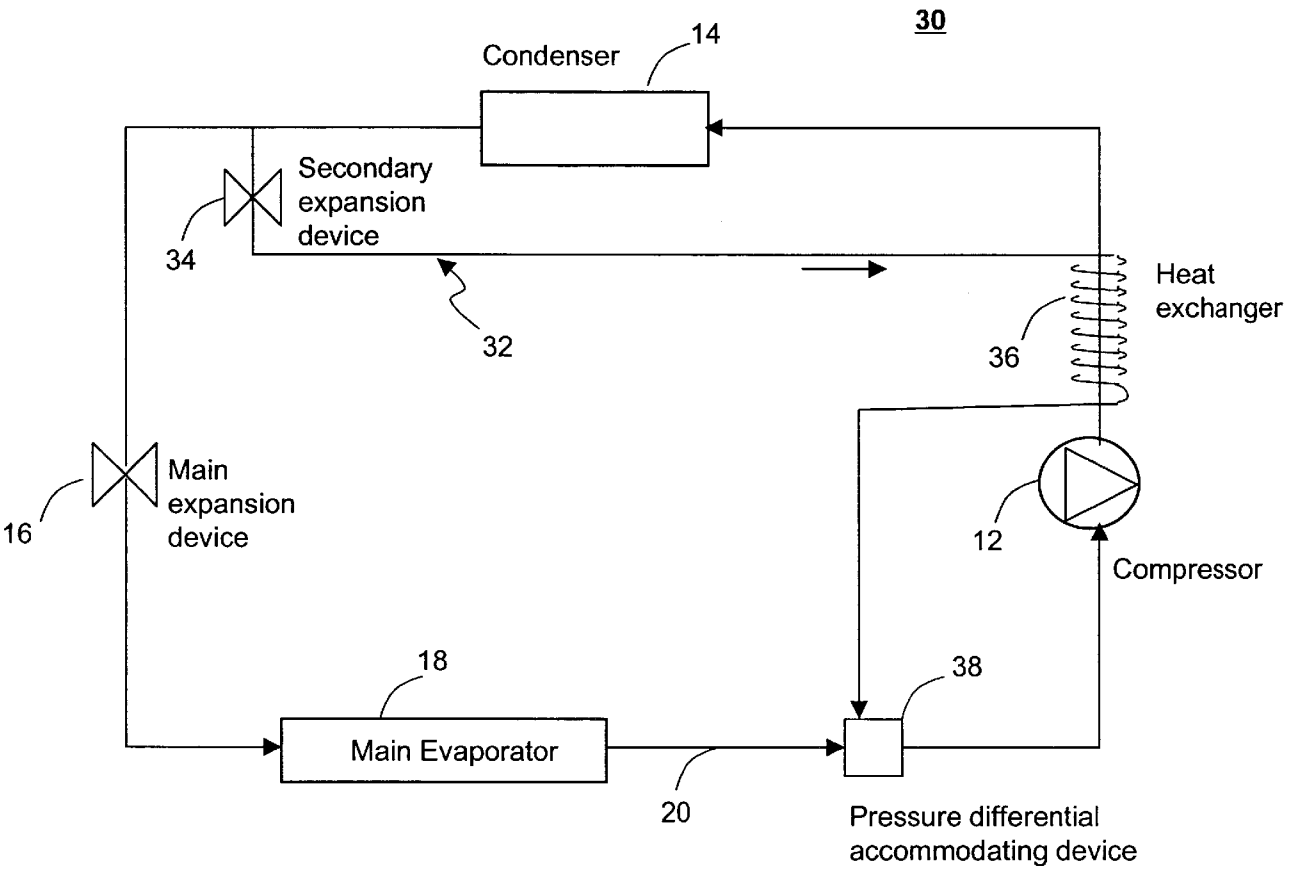
FIG. 5 shows a block diagram of an embodiment of the present invention in which a heat exchanger in a bypass line removes heat from the discharge vapor from the compressor, and a pressure differential accommodating device is used to mix two vapors at two different pressures.

FIG. 5 illustrates in block diagram form, a first embodiment of the invention. The system of FIG. 5, generally denoted at 30, is similar to that of FIG. 1, except that a secondary bypass path 32 is coupled between the outlet of condenser 14, and the inlet of compressor 12. Bypass path 32 includes a secondary expansion device 34. A heat exchanger 36 thermally coupled between the outlet of compressor 12 and the inlet of condenser 14, and a pressure differential accommodating device 38, which mixes the refrigerant exiting the evaporator 18 and the heat exchanger 36 for return to the inlet of compressor 12. Pressure differential accommodating device 38 is needed because, as shown, the pressure at the outlet of the evaporator may be lower than the pressure at the outlet of the heat exchanger.

The pressure differential accommodating device 38 can be either a vacuum generating device such as a vortex generator or a venturi tube or a pressure reducing device. The construction of a vortex generator is shown schematically in FIGS. 6A and 6B.

The design of the vortex generator, generally denoted at 40, is derived from the so-called vortex tube, a known device which converts an incoming flow of compressed gas into two outlet streams—one stream hotter than and the other stream colder than the temperature of the gas supplied to the vortex tube. A vortex tube does not contain any moving parts. Such a device is illustrated in our U.S. Pat. No. 6,250,086, which is hereby incorporated herein by reference.

Figures 6A, 6B:
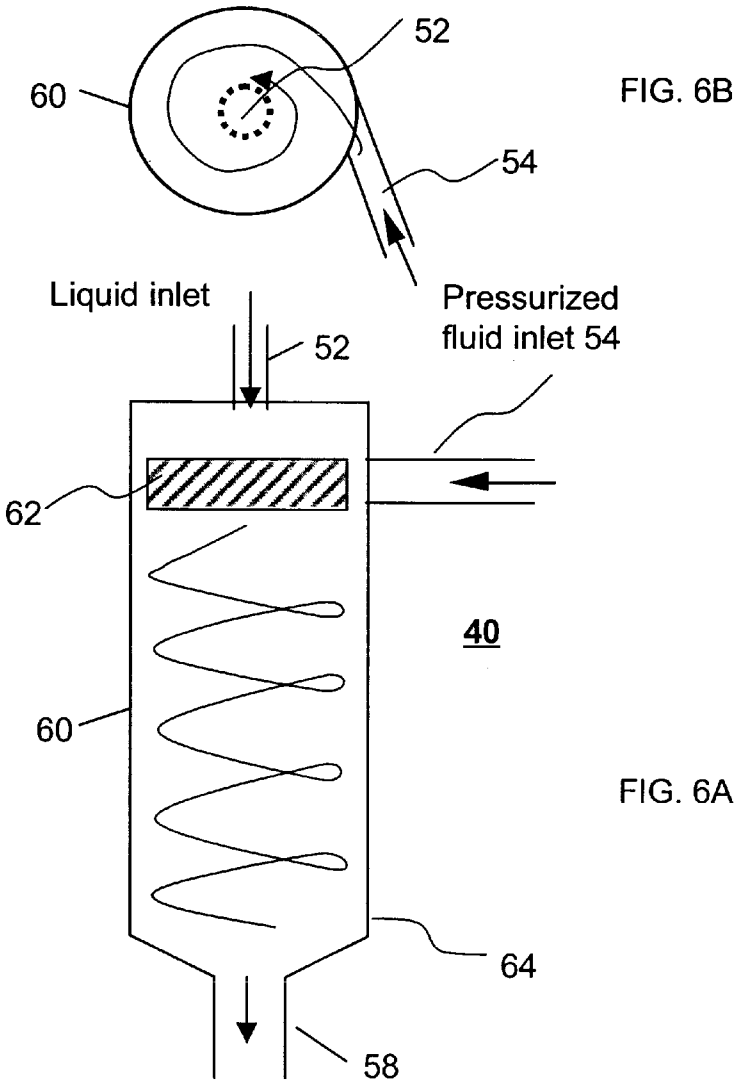
FIGS. 6A and 6B illustrate the construction of a vortex generator which may be used as a pressure differential accommodating device according to the invention.

As illustrated in FIGS. 6A and 6B, vortex generator 40 is used to mix two vapors at different pressures into one stream. The present invention uses the vortex generator as a mixing means. It is comprised of a tubular body 60, with an axial inlet 52 and a tangential inlet 54 at an inlet end 62, and an outlet 58 at an opposite outlet end 64. The interior construction of tube 60 at the inlet end is such that a high-pressure gas stream entering tangential inlet 54 travels along a helical path toward the outlet 58. This produces a strong vortex flow in tube 60, and a radial pressure differential due to the centrifugal force created by the vortex flow forces the vapor radially outward and produces high pressure at the periphery and low pressure at the axis. The low pressure allows fluid drawn in through axial inlet 52 to mix with the high-pressure helical stream and to exit with it through outlet. 58.

Further information concerning vortex generator 40 may be found in the Cho, Bai, Lee application Ser. No. 60/356,059 mentioned above.

In the system illustrated in FIG. 5, the high-pressure tangential flow is provided through tube 54 from heat exchanger 36, and the incoming stream at axial inlet 52 is provided from the outlet of evaporator 18. Using a vacuum-generating device based on the vortex generator makes it possible to combine the refrigerant exiting from evaporator 18 and the higher pressure refrigerant exiting from heat exchanger 36 without the need for a costly pump having moving parts.

Figure 7:
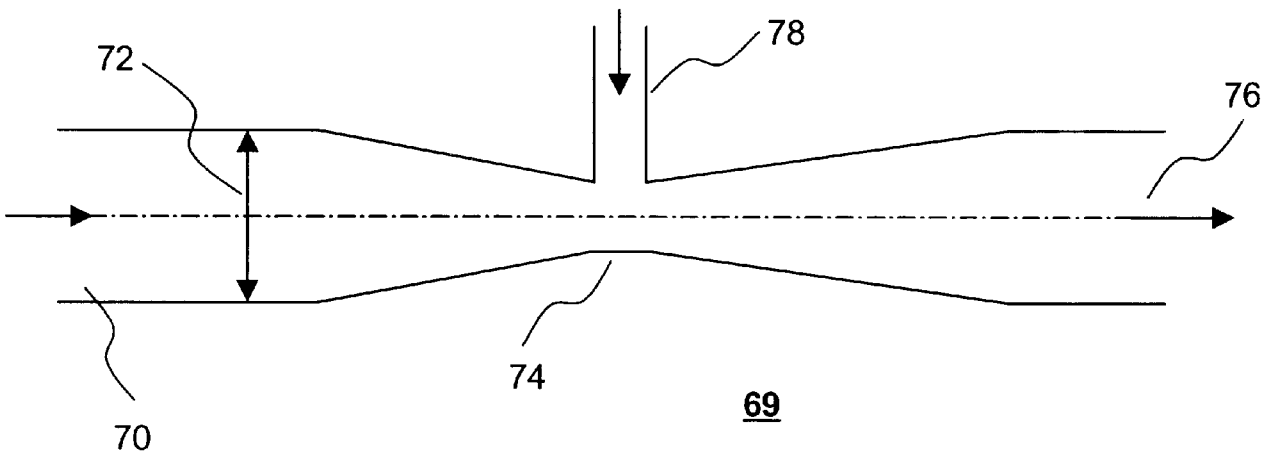
FIG. 7 illustrates the construction of a venturi tube which may be used instead of the vortex generator shown in FIGS. 6A and 6B.

Other devices which rely on geometry and fluid dynamics may also be used to generate a vacuum which permits mixing the refrigerant streams exiting from evaporator 18 and heat exchanger 36. For example, a device operating on the principle of a venturi tube may also be used. In such a device, as illustrated in FIG. 7 at 69, a high pressure fluid stream (here, the refrigerant exiting from heat exchanger 36), enters axially into an elongated tube 70 having an interior diameter 72 which decreases gradually to a point of minimum diameter 74 and thereafter increases gradually toward an outlet end 76. As the cross-sectional area decreases, the vapor stream is accelerated. According to Bernoulli's principle, the pressure decreases, and reaches a minimum at the so-called "throat corresponding to the point of minimum diameter 74 where a vacuum is created.

A radial inlet 78 is provided at the low-pressure point. This is connected to the outlet of evaporator 18 (see FIG. 5), thereby permitting mixing of the evaporator outflow with the axial stream from heat exchanger 36.

Referring again to FIG. 5, in operation, a portion of the liquid refrigerant exiting from condenser 14 is diverted into bypass path 32, for example, by a suitable valve (not shown). The diverted refrigerant passes through secondary expansion device 34 and then through heat exchanger 36 which performs the de-superheating function conventionally performed by the upstream portion of the condenser.

By proper selection of system parameters, in particular, the mass flow rate of refrigerant diverted to the bypass path, the refrigerant can be made to enter condenser 14 at or close to the saturation temperature, and the entire flow path through the condenser can be devoted to the phase-change operation by transfer of heat to the environment, whereby maximum condenser efficiency can be achieved. It has been found that this requires diversion of 10–15% of the liquid refrigerant outflow from the condenser to the bypass path.

More particularly, providing a bypass path for de-superheating makes the condenser more efficient thereby reducing the condenser pressure, which, in turn, decreases the pressure lift at compressor, thus reducing the compressor work. The coefficient of performance ("COP") of a refrigeration system, sometimes termed the energy-efficiency ratio (EER), is defined as $Q_v/W_c$, where $Q_v$ is the heat absorption by the evaporator of the system and $W_c$ is the work done by the compressor. As will be appreciated, a decrease in $W_c$ increases the COP and the EER.

Correspondingly, because de-superheating does not have to be done inside condenser 14, the condenser becomes more efficient, and subcooling at the end of the condenser is increased. This increases the amount of liquid refrigerant after the throttling process through the main expansion valve 16. Thus, the heat absorption at evaporator 18 (often referred as the cooling capacity) increases.

Referring still to FIG. 5, by proper design of the vacuum generating device such as vortex generator 40 illustrated in FIGS. 6A and 6B, or venturi tube 69 illustrated in FIG. 7, the pressure at the low pressure inlet can be made lower than the inlet pressure at main evaporator 18. As a consequence, a pressure drop may be imposed across the evaporator. This is advantageous in that the lower evaporator outlet pressure means that the evaporator temperature differential is greater, resulting in enhanced evaporator capacity.

Of even more significance, after the mixing of the two vapor streams from heat exchanger 36 and evaporator 18, the pressure of the combined stream can have a higher pressure than the evaporator inlet pressure. This means that the suction pressure at the compressor inlet is increased, which reduces the required pressure lift across the compressor. The reduced compressor work can provide a beneficial increase in the EER.

Figure 8:
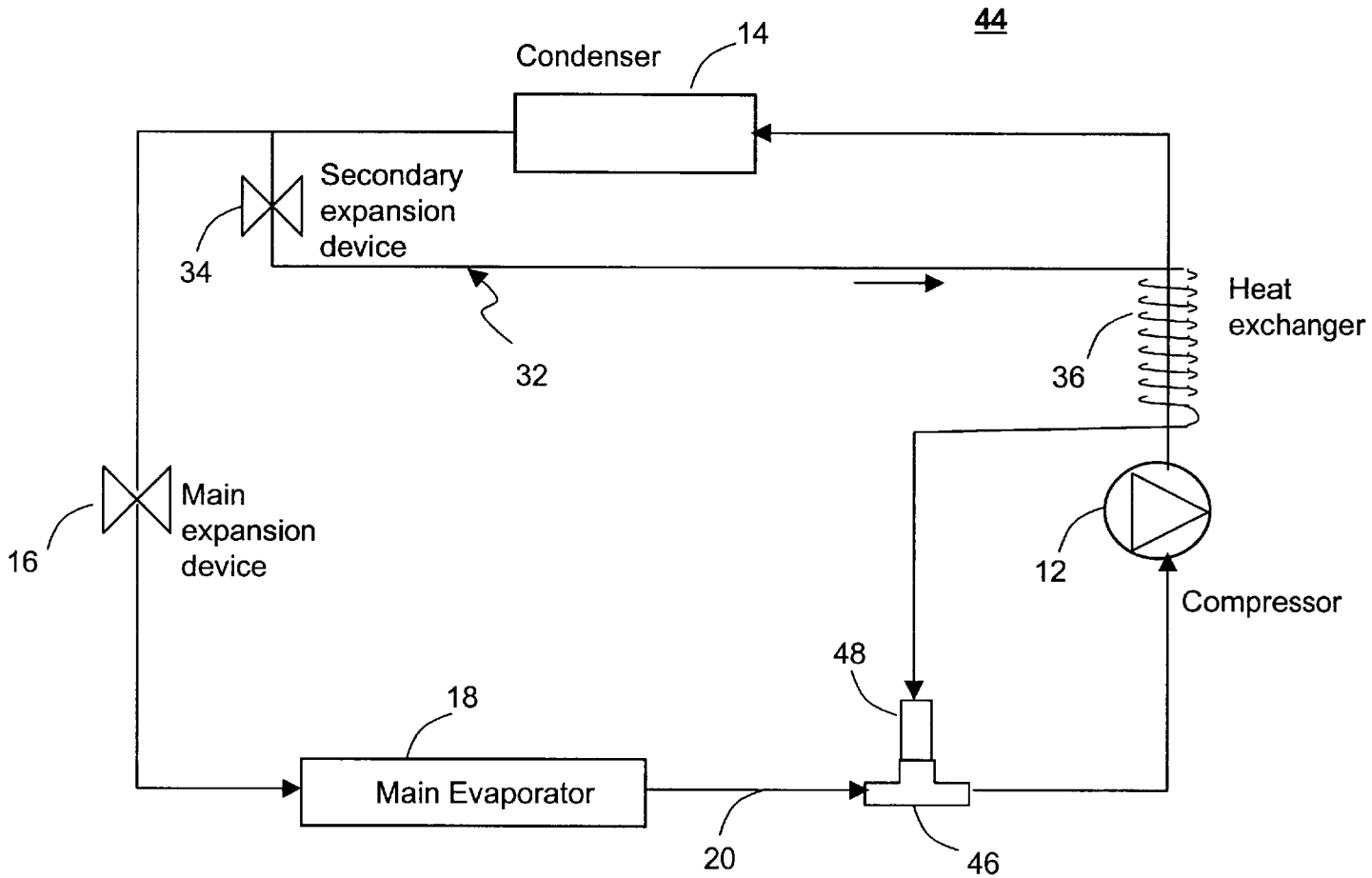
FIG. 8 shows a block diagram of an embodiment of the present invention in which a heat exchanger in a bypass line removes heat from the discharge vapor from the compressor, and a pressure-reducing device is used at the bypass line to reduce the high pressure at the bypass line to a level at the evaporator so that two vapors at two different pressures can be mixed.

FIG. 8 shows a system, generally denoted at 44, which is similar to system 30 shown in FIG. 5, but which uses pressure reducing device 48 to reduce the high pressure at the bypass line to a pressure level of the evaporator so that the two vapors can be mixed between the evaporator and the compressor. Pressure reducing device 48 can be any mechanism which reduces pressure via friction of sudden pressure drop such as a capillary tube, an orifice, a valve, a porous plug, or the like. A conventional Tee function 46 may be used to mix the vapor exiting evaporator 18 with that exiting pressure reducing device 48.

Figure 9:
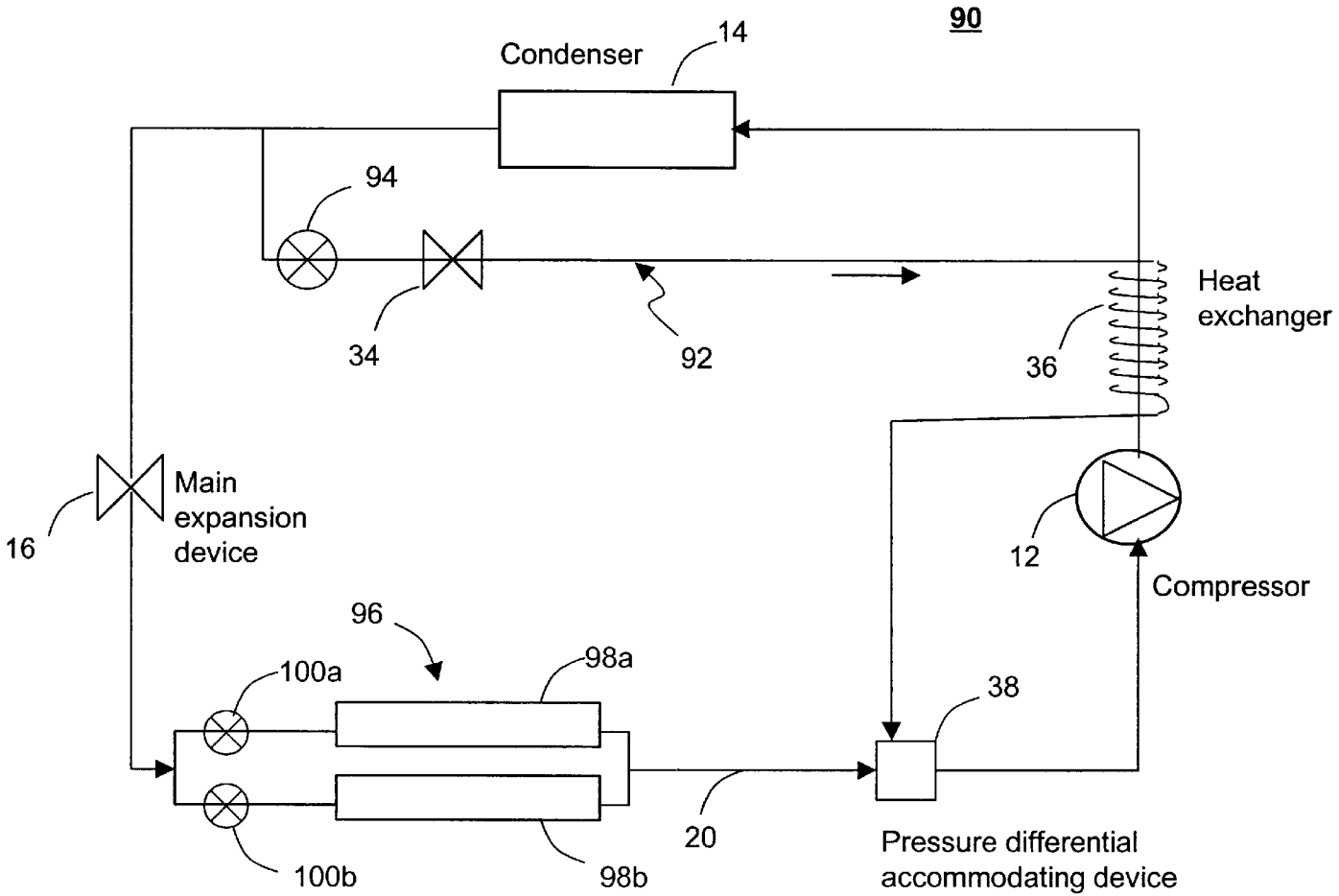
FIG. 9 is a block diagram showing application of the present invention to a zoned cooling system.

FIG. 9 illustrates a zoned air conditioning system embodying the principles of this invention, generally denoted at 90. This differs from system 30 illustrated in FIG. 5 in that bypass path 92 includes an adjustable control valve 94, and the evaporator 96 is formed of several parallel-connector evaporator units 98*a* and 98*b* located to serve different rooms, and respectively connected to the main expansion device 16 by ON-OFF valves 100*a* and 100*b*. System 90 is thus configured to provide two separate cooling zones, but as will be appreciated, more zones can be provided if desired.

The outlets of evaporator units 98*a* and 98*b* are at the same pressure, and are therefore connected in common to the input of pressure differential accommodating device 38.

In operation, when cooling in both zones is required, valves 100*a* and 100*b* are opened, and refrigerant flows through both evaporators 98*a* and 98*b*. Valve 94 is adjusted to divert between 10 and 15 percent of the refrigerant from condenser 14 into bypass path 92 to achieve maximum cooling and efficiency. Thus, all of the benefits of the de-superheating bypass described in connection with FIG. 5 are also realized in system 90.

As an additional feature of system 90, however, if cooling is required, e.g., only in the zone served by evaporator unit 98*a*, valve 100*a* is opened, valve 100*b* is closed, and valve 94 is adjusted to divert the refrigerant which would otherwise flow through evaporator 98*b* into bypass path 92, along with the refrigerant required for de-superheating.

To vary the bypass mass flow rate, valve 94 in bypass line 92 should be continuously adjustable or adjustable in steps, to provide the desired number of different flow rates. For example, 10% diversion could be provided for maximum performance, with 20%, 30%, and 40% diversion for reduced cooling capacity. Valves providing the above-described capability are commercially available and any suitable or desired valve of this type may be employed.

As previously indicated, maximum efficiency and cooling capacity are achieved by diversion of 10–15% of the refrigerant mass flow to bypass path 92. As the amount of refrigerant diverted is increased beyond 15%, for example, up to 30% or more, the cooling capacity is reduced due to the substantial decrease in the refrigerant mass flow rate circulating through evaporator 96. Thus, by diverting the refrigerant not needed in the idle evaporator, the cooling capacity can be made to vary according to the thermal load, without the need for repeated on-off cycling of the compressor or resort to costly variable speed compressors.

This is particularly advantageous in that cycling the compressor on and off consumes a large quantity of energy. Eliminating this inefficiency results in significantly improved long-term energy efficiency, a parameter sometimes measured in terms of seasonal energy-efficiency ratio (SEER), which takes account of ON/OFF operation of the compressor on the efficiency of the system. SEER is defined as the ratio of the sum of $Q_v$ (heat absorbed by the evaporator) times the hours of operation to the sum of $W_c$ (compressor work) times the hours of operation.

As will also be appreciated, variable cooling capacity can be provided in a single-zone system such as illustrated in FIG. 5. Here, additional refrigerant would be diverted to bypass path 32 to accommodate a decrease in required cooling capacity, and the system could operate without the need for frequent compressor on-off cycling.

In the constructions described above, it has been assumed that a single refrigerant circulates through the system. Desuperheating bypass can also be used in conjunction with mixed refrigerants in regenerative systems to achieve highly beneficial results.

Figure 10:
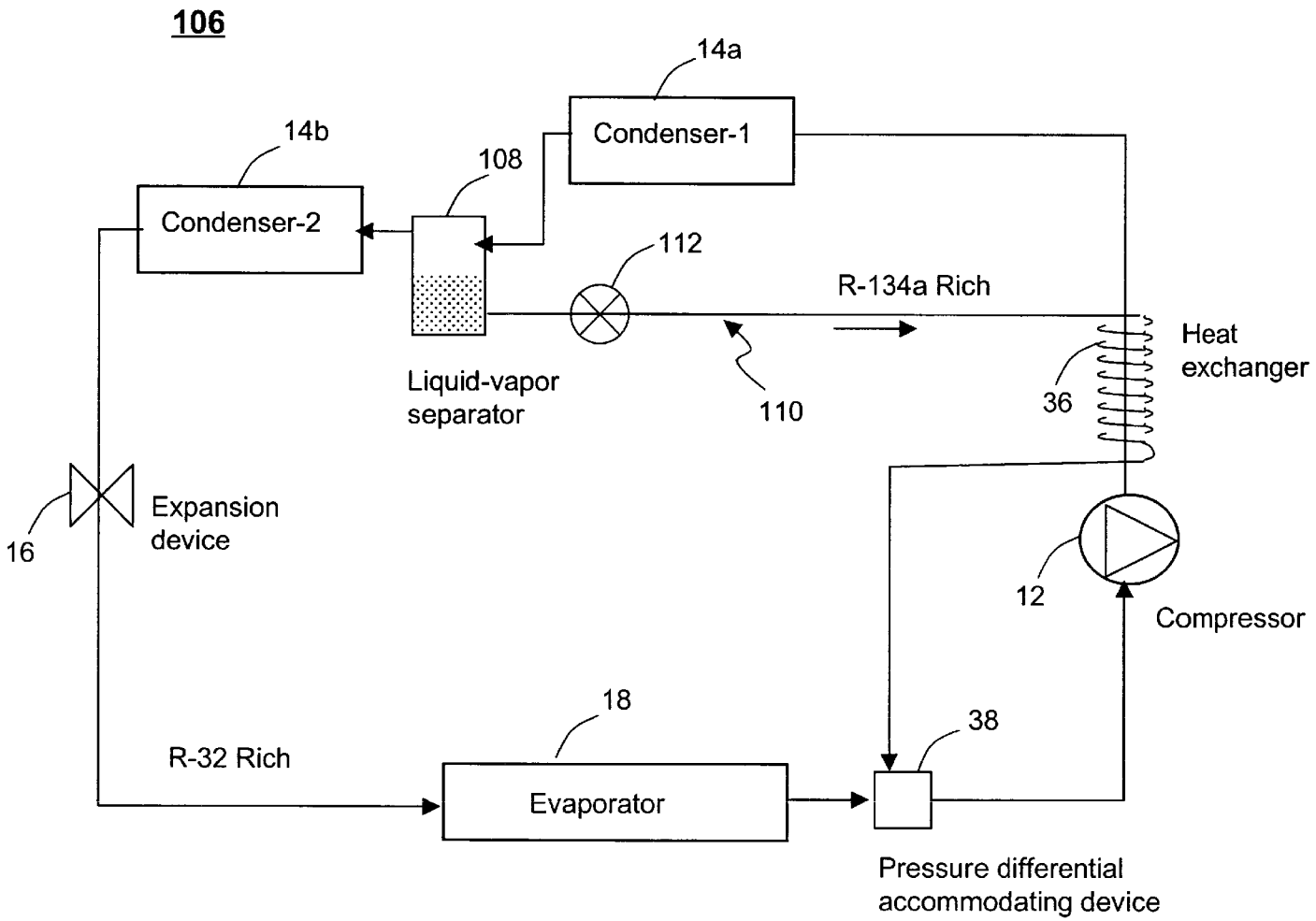
FIG. 10 is a block diagram showing application of the present invention to a mixed-refrigerant system.

FIG. 10 illustrates use of de-superheating bypass in a simple mixed-refrigerant system, employing, for example, a mixture of refrigerants R-32, R-125, and R-134a. This is a commonly used beneficial combination as the R-32 component is flammable, but possesses excellent thermal characteristics, while the R-125 and R-134a components exhibit less desirable thermal characteristics than R-32 but are non-flammable. In the interest of simplicity, various possible regenerative paths as illustrated in our above-identified U.S. Patents have been omitted from the illustrative system of FIG. 10.

The system, generally denoted at 106, comprises a compressor 12, an expansion device 16, an evaporator 18, a heat exchanger 36, and a pressure differential accommodating device 38 in a bypass path 110 as in system 30 (see FIG. 5). The condenser, however, is split into two stages 14*a* and 14*b*, and a liquid-vapor (LV) separator 108 of any suitable or desired type is provided between the two condenser stages.

LV separator 108 functions to separate the incoming vapor stream exiting from condenser stage 14*a* into a first vapor component which passes to the inlet of condenser stage 14*b*, and a second lower temperature liquid component a portion of which passes through a valve 112 to the inlet of heat exchanger 36.

The second component exiting from LV separator 108 is rich in the R-134a refrigerant due to its high condensation and boiling point relative to the other refrigerant components. Aside from the advantages of performing the de-superheating step outside condenser stage 14*a* as described above, the R-134a-rich composition of the refrigerant in the bypass path to the condenser in liquid form has the added benefit of reducing the condenser pressure.

As indicated above, the system illustrated in FIG. 10 is representative of the application of the principles of this invention to mixed-refrigerant regenerative systems. It should be understood, however, that de-superheating bypass is applicable to other mixed-refrigerant regenerative system configurations as well.

In describing the invention, specific terminology has been employed for the sake of clarity. However, the invention is not intended to be limited to the specific descriptive terms, and it is to be understood that each specific term includes all technical equivalents that operate in a similar manner to accomplish a similar purpose.

Similarly, the embodiments described and illustrated are also intended to be exemplary, and various changes and modifications, and other embodiments within the scope of the invention will be apparent to those skilled in the art in light of the disclosure. The scope of the invention is therefore intended to be defined and limited only by the appended claims, and not by the description herein.

I claim:

1. A method of increasing the efficiency of a refrigeration system comprised of a primary refrigerant path including a compressor, a condenser, a primary expansion device, and an evaporator connected together to form a closed loop system with a refrigerant circulating therein, the method comprising the steps of:

diverting a portion of the refrigerant exiting the condenser into a bypass refrigerant line;

passing the diverted refrigerant through a secondary expansion device in the bypass line;

passing the refrigerant exiting the secondary expansion device through a heat exchanger thermally coupled to the primary refrigerant path between the compressor outlet and the condenser inlet to remove heat from the discharge vapor from the compressor;

passing the refrigerant exiting the heat exchanger and the refrigerant exiting the evaporator through a pressure differential accommodating device means that mixes two vapors at different pressures; and feeding the refrigerant exiting the pressure differential accommodating device to an inlet of the compressor.

2. A method as described in claim 1, wherein between approximately 10 and approximately 15 percent of the mass flow of refrigerant exiting the condenser is diverted into the bypass path.

3. A method as described in claim 1, further including the step of controlling the mass flow of refrigerant exiting the condenser that is diverted into the bypass path to provide a maximum cooling capacity when a predetermined minimum quantity of refrigerant is diverted, with the cooling capacity decreasing as the amount of diverted refrigerant is increased, whereby variable cooling capacity can be achieved without the need to repeatedly adjust the operation of the compressor.

4. A method as described in claim 1, wherein the pressure differential accommodating device is a vacuum generator that creates an evaporator exit pressure substantially lower than the evaporator inlet pressure whereby the evaporator capacity is enhanced.

5. A method as described in claim 1, wherein the pressure differential accommodating device is a vacuum generator that creates a compressor inlet pressure that is higher than the evaporator inlet pressure whereby the pressure lift across the compressor is reduced.

6. A method of operating a zoned refrigeration system with increased efficiency, the system being comprised of a primary refrigerant path including a compressor, a condenser, a primary expansion device, and a plurality of parallel-connected evaporator units located respectively to serve the zones of the space being refrigerated, the components being connected together to form a closed loop system with a refrigerant circulating therein, the method comprising the steps of:

separately controlling the flow of refrigerant from the expansion device to each of the evaporator units so that refrigerant only flows through evaporator units which are required to provide cooling at a given time;

diverting a portion of the refrigerant exiting the condenser into a bypass refrigerant line;

passing the diverted refrigerant through a secondary expansion device in the bypass line;

passing the refrigerant exiting the secondary expansion device through a heat exchanger thermally coupled to the primary refrigerant path between the compressor outlet and the condenser inlet to remove heat from the discharge vapor from the compressor, whereby the refrigerant exiting the compressor is at or near its saturation temperature;

passing the refrigerant in the bypass path exiting the heat exchanger and the refrigerant exiting the evaporator through a pressure differential accommodating device that mixes two vapors at different pressures; and feeding the refrigerant exiting the pressure differential accommodating device to an inlet of the compressor, the quantity of refrigerant diverted to the bypass line being a predetermined minimum amount necessary to reduce the temperature of the refrigerant exiting the compressor to or near to its saturation temperature, plus an additional amount sufficient to reduce the cooling capacity to a decreased level if required at a given time, whereby variable cooling capacity can be achieved without the need to repeatedly adjust the operation of the compressor.

7. A refrigeration system comprising:

a compressor, a condenser, an expansion device, and an evaporator, connected together to form a closed loop system with a refrigerant circulating therein; and a bypass path coupled between an outlet of the condenser and an inlet of the compressor, the bypass path including:

a heat exchanger thermally coupled between an outlet of the compressor and an inlet of the condenser; and a pressure differential accommodating device having a first inlet connected to the outlet of the heat exchanger, a second inlet connected to the outlet of the evaporator, and an outlet connected to the inlet of the compressor, the heat exchanger being operative to reduce the temperature of refrigerant exiting the compressor from a superheated temperature to a temperature which is approximately equal to the saturation temperature, thereby reducing the condenser pressure, and consequently, the pressure lift at the compressor, and the compressor work.

8. A refrigeration system as described in claim 7, further including a valve at the inlet end of the bypass path, the valve being adjusted to divert between approximately 10 and approximately 15 percent of the mass flow of the refrigerant exiting the condenser into the bypass path.

9. A refrigeration system as described in claim 7, further including a first valve at the inlet end of the bypass path, the first valve being adjustable to divert a controllable quantity of the mass flow of the refrigerant exiting the condenser into the bypass path.

10. A refrigeration system as described in claim 9, wherein the evaporator is comprised of a plurality of parallel-connected evaporator units located to serve different portions of a space being cooled, each evaporator unit being connected to the outlet of the expansion device by a respective one of a plurality of controllable second valves, and in common to the low-pressure inlet of the pressure differential accommodating device.

11. A refrigeration system as described in claim 10, wherein the first valve and the plurality of second valves are controllable to divert a predetermined minimum quantity of refrigerant to the bypass path when maximum cooling is required, and to divert increasing quantities of refrigerant to the bypass path as one of more of the plurality of second valves are closed, thereby reducing the system cooling capacity without the need to adjust the operation or cycle of the compressor.

12. A refrigeration system as described in claim 7, further including a liquid-vapor separator having an inlet, a first outlet for a vapor component and a second outlet for a liquid component, and wherein:

the refrigerant is a combination of constituents having different properties;

the condenser is comprised of:

a first stage having an outlet connected to the inlet of the liquid-vapor separator; and a second stage having an inlet connected to the first outlet of the liquid-vapor separator;

the second outlet of the liquid-vapor separator is connected to the bypass path.

13. A refrigeration system as described in claim 7, wherein the pressure differential accommodating device is a vacuum generator that creates an evaporator exit pressure substantially lower than the evaporator inlet pressure whereby the evaporator capacity is enhanced.

14. A refrigeration system as described in claim 7, wherein the pressure differential accommodating device is a vacuum generator that creates a compressor inlet pressure that is higher than the evaporator inlet pressure whereby the pressure lift across the compressor is reduced.

15. A refrigeration system comprising:

a compressor, a condenser, an expansion device, and an evaporator, connected together to form a closed loop system with a refrigerant circulating therein; and a bypass path coupled between an outlet of the condenser and an inlet of the compressor, the bypass path being comprised of:

a heat exchanger thermally coupled between an outlet of the compressor and an inlet of the condenser; and a pressure differential accommodating device having a first inlet connected to the outlet of the heat exchanger, a second inlet connected to the outlet of the evaporator, and an outlet connected to the inlet of the compressor, the heat exchanger being operative to reduce the temperature of refrigerant exiting the compressor from a superheated temperature to a temperature which is approximately equal to the saturation temperature, thereby increasing the subcooling at the condenser outlet and consequently, the amount of liquid refrigerant passing into the evaporator, and the cooling capacity thereof.

16. A refrigeration system as described in claim 15, further including a valve at the inlet end of the bypass path, the valve being adjusted to divert between approximately 10 and approximately 15 percent of the mass flow of the refrigerant exiting the condenser into the bypass path.

17. A refrigeration system as described in claim 15, further including a valve at the inlet end of the bypass path, the valve being adjustable to divert a controllable quantity of the mass flow exiting the condenser into the bypass path.

18. A refrigeration system as described in claim 17, wherein the evaporator is comprised of a plurality of parallel-connected evaporator units located to serve different portions of a space being cooled, each evaporator unit being connected to the outlet of the expansion device by a respective one of a plurality of controllable second valves, and in common to the low-pressure inlet of the pressure differential accommodating device.

19. A refrigeration system as described in claim 8, wherein the first valve and the plurality of second valves are controllable to divert a predetermined minimum quantity of refrigerant to the bypass path when maximum cooling is required, and to divert increasing quantities of refrigerant to the bypass path as one of more of the plurality of second valves are closed, thereby reducing the system cooling capacity without the need to adjust the operation of the compressor.

20. A refrigeration system as described in claim 15, further including a liquid-vapor separator having an inlet, a first outlet for a vapor component and a second outlet for a liquid component, and wherein:

the refrigerant is a combination of constituents having different properties;

the condenser is comprised of:

a first stage having an outlet connected to the inlet of the liquid-vapor separator; and a second stage having an inlet connected to the first outlet of the liquid-vapor separator;

the second outlet of the liquid-vapor separator is connected to the bypass path.

21. A refrigeration system as described in claim 15, wherein the pressure differential accommodating device is a vacuum generator that creates an evaporator exit pressure substantially lower than the evaporator inlet pressure whereby the evaporator capacity is enhanced.

22. A refrigeration system as described in claim 15, wherein the pressure differential accommodating device is a vacuum generator that creates a compressor inlet pressure that is higher than the evaporator inlet pressure whereby the pressure lift across the compressor is reduced.

23. A refrigeration system comprised of:

a primary refrigerant path including a compressor, a condenser, a primary expansion device, and an evaporator connected together to form a closed loop system with a refrigerant circulating therein; and a bypass line connected between the outlet of the condenser and the inlet of the compressor, the bypass line including:

a heat exchanger thermally coupled to the primary refrigerant path between the compressor outlet and the condenser inlet to remove heat from the discharge vapor from the compressor; and a pressure differential accommodating device for mixing two vapors at two different pressures connecting the outlets of the evaporator and the heat exchanger to an inlet of the compressor.

24. A refrigeration system as described in claim 23, further including a valve at the inlet end of the bypass path, the valve being adjusted to divert between approximately 10 and approximately 15 percent of the mass flow exiting the condenser into the bypass path.

25. A refrigeration system as described in claim 23, further including a valve at the inlet end of the bypass path, the valve being adjustable to divert a controllable quantity of the mass flow exiting the condenser into the bypass path.

26. A refrigeration system as described in claim 25, wherein the evaporator is comprised of a plurality of parallel-connected evaporator units located to serve different portions of a space being cooled, each evaporator unit being connected to the outlet of the expansion device by a respective one of a plurality of controllable second valves, and in common to an inlet of the pressure differential accommodating device.

27. A refrigeration system as described in claim 20, wherein the first valve and the plurality of second valves are controllable to divert a predetermined minimum quantity of refrigerant to the bypass path when maximum cooling is required, and to divert increasing quantities of refrigerant to the bypass path as one of more of the plurality of second valves are closed, thereby reducing the system cooling capacity without the need to adjust the operation of the compressor.

28. A refrigeration system as described in claim 23, further including a liquid-vapor separator having an inlet, a first outlet for a vapor component and a second outlet for a liquid component, and wherein:

the refrigerant is a combination of constituents having different properties;

the condenser is comprised of:

a first stage having an outlet connected to the inlet of the liquid-vapor separator; and a second stage having an inlet connected to the first outlet of the liquid-vapor separator;

the second outlet of the liquid-vapor separator is connected to the bypass path.

29. A refrigeration system according to claim 23, wherein the pressure differential accommodating device is a pressure reducing device without moving parts which reduces the high pressure at the bypass line to the pressure level at the evaporator.

30. A refrigeration system according to claim 23, wherein the pressure differential accommodating device is a device to reduce pressure utilizing friction or sudden flow change.

31. A refrigeration system according to claim 30, wherein the pressure reducing device is a capillary tube, an orifice, a valve or a porous plug.

32. A refrigeration system according to claim 23, wherein the pressure differential accommodating device is a vacuum generating device without moving parts which generates a pressure differential at an input thereof as a result of fluid flow therethrough, and the geometry thereof.

33. A refrigeration system according to claim 32, wherein the pressure differential is generated by vortex flow of a pressurized fluid.

34. A refrigeration system according to claim 32, wherein the pressure differential is generated by flow of a pressurized fluid through a passage of gradually decreasing cross section.

35. A refrigeration system according to claim 32, wherein the vacuum-generating device is comprised of:

a tubular body having an inlet end and an axially opposite outlet end;

a first inlet disposed axially at the inlet end of the tubular body;

a second inlet disposed tangentially at the inlet end of the body, the second inlet and the geometry of the inlet end of the body being operative to cause helical flow of fluid entering the second inlet toward the outlet end of the tubular body; and an axially disposed outlet at the outlet end of the tubular body, the helical flow path producing a lower pressure along the axis of the tubular member compared to that at the radially outer end thereof.

36. A refrigeration system according to claim 35, wherein:

the first inlet is connected to the outlet of the evaporator;

the second inlet is connected to the outlet of the heat exchanger; and the outlet is connected to the inlet of the compressor.

37. A refrigeration system according to claim 32, wherein the vacuum-generating device is comprised of:

a tubular body having first and second opposite ends;

a first fluid inlet disposed axially at the first end of the tubular body;

a fluid outlet axially disposed outlet at the second end of the tubular body, the passage between the first inlet and the outlet having a cross-sectional area which decreases to a throat of minimum cross-section; and a second fluid inlet disposed radially at the throat inlet end of the body, the flow of fluid from the first inlet through the throat being operative to produce a lower pressure at the throat and the second inlet compared to that at the first inlet.

38. A refrigeration system according to claim 37, wherein:

the first inlet is connected to an outlet of the heat exchanger;

the second inlet is connected to the outlet of the evaporator; and the outlet is connected to the inlet of the compressor.

39. A refrigeration system as described in claim 23, wherein the pressure differential accommodating device is a vacuum generator that creates an evaporator exit pressure substantially lower than the evaporator inlet pressure whereby the evaporator capacity is enhanced.

40. A refrigeration system as described in claim 23, wherein the pressure differential accommodating device is a vacuum generator that creates a compressor inlet pressure that is higher than the evaporator inlet pressure whereby the pressure lift across the compressor is reduced.

* * * * *